US006694521B1

(12) United States Patent
Hopkins

(10) Patent No.: US 6,694,521 B1
(45) Date of Patent: Feb. 24, 2004

(54) PREMATURE INFANT GOWN

(76) Inventor: Rosetta L. Hopkins, 601 E. 32nd St., Apt. 200, Chicago, IL (US) 60610

( * ) Notice: Subject to any disclaimer, the term of this patent is extended or adjusted under 35 U.S.C. 154(b) by 0 days.

(21) Appl. No.: 10/288,142

(22) Filed: Nov. 5, 2002

(51) Int. Cl.[7] ..... A41D 10/00
(52) U.S. Cl. ..... 2/83; 2/80; 2/114
(58) Field of Search ..... 2/75, 80, 83, 111, 2/69, 69.5, 114, 102, 46, 73, 78.2, 78.3, 78.4, 108, 109, 401, 402, 408, 338, 48, 52; 604/345, 174, 179; 128/DIG. 26, 134, 132, 133

(56) References Cited

U.S. PATENT DOCUMENTS

| | | | | | |
|---|---|---|---|---|---|
| 459,106 | A | * | 9/1891 | Fifield | 2/114 |
| 818,351 | A | * | 4/1906 | Clark | 2/114 |
| 1,462,515 | A | * | 7/1923 | McElroy | 2/72 |
| 1,489,046 | A | * | 4/1924 | Thompson | 2/114 |
| 1,731,137 | A | * | 10/1929 | Jones | 2/74 |
| 2,497,764 | A | * | 2/1950 | Doughty | 2/114 |
| 2,704,070 | A | * | 3/1955 | Rudisill | 450/113 |
| 2,736,900 | A | * | 3/1956 | Koren | 2/114 |
| 3,116,491 | A | * | 1/1964 | Previdi et al. | 2/106 |
| 3,276,036 | A | * | 10/1966 | Cater | 2/114 |
| 3,490,072 | A | * | 1/1970 | Keltner | 2/114 |
| 3,721,998 | A | * | 3/1973 | Meyers | 2/74 |
| 4,055,855 | A | * | 11/1977 | Ragone et al. | 2/105 |
| 4,382,303 | A | * | 5/1983 | Lunt | 2/114 |
| 4,570,268 | A | * | 2/1986 | Freeman | 2/114 |
| 4,674,130 | A | | 6/1987 | Coudron | |
| 4,688,270 | A | * | 8/1987 | Denicola et al. | 2/102 |
| 4,718,124 | A | * | 1/1988 | Sawicki et al. | 2/114 |
| 4,737,995 | A | * | 4/1988 | Wiley | 2/114 |
| 4,747,413 | A | * | 5/1988 | Bloch | 600/549 |
| 4,783,855 | A | * | 11/1988 | Njegovan | 2/69.5 |
| D305,575 | S | * | 1/1990 | Gordon et al. | D2/720 |
| 4,995,115 | A | * | 2/1991 | Ellis | 2/69 |
| 5,048,122 | A | * | 9/1991 | Prieur | 2/69 |
| 5,184,351 | A | * | 2/1993 | Benstock | 2/114 |
| 5,274,852 | A | * | 1/1994 | Hogan | 2/114 |
| 5,367,709 | A | | 11/1994 | Teasley | |
| 5,440,763 | A | * | 8/1995 | Shah et al. | 2/114 |
| 5,564,123 | A | * | 10/1996 | Grassick | 2/69 |

(List continued on next page.)

OTHER PUBLICATIONS

Mari E. Bergen, Linda Capjack, Linda McConnan, Elizabeth Richards, Design and Evalution of Clothing of the Neonate, Clothin and Textile Research Journal: International Textile and Apparel Association, vol. 14 #4 1996, pp. 225–233.*

*Primary Examiner*—John J. Calvert
*Assistant Examiner*—Alissa L. Hoey
(74) *Attorney, Agent, or Firm*—Wallenstein Wagner & Rockey, Ltd.

(57) ABSTRACT

A gown for premature infants and the like. The gown comprises front and back sections which together envelop the entire body and upper arms of an infant when worn. The rear section is a single piece and the front section comprises a pair of complementary portions. The front and rear sections are permanently connected at a perimeter area of permanent connection proximate the armpits, and remaining perimeter areas can be temporarily connected so that the front body portions are selectively and completely severable from the rear section except at the perimeter area of permanent connection. Tie straps are provided for temporarily connecting front body panel portions to one another.

6 Claims, 2 Drawing Sheets

U.S. PATENT DOCUMENTS 5,564,126 A * 10/1996 Chou ..... 2/114
5,611,087 A * 3/1997 Adkins ..... 2/114
5,621,917 A * 4/1997 Howsden ..... 2/111
5,806,096 A * 9/1998 Pennington ..... 2/80
5,887,279 A * 3/1999 Elting et al. ..... 2/69
5,991,923 A * 11/1999 Maria ..... 2/83
6,012,166 A * 1/2000 Burbidge ..... 2/83
6,032,289 A * 3/2000 Villapiano ..... 2/102
6,049,909 A * 4/2000 Anderson ..... 2/111
6,216,271 B1 * 4/2001 Chen ..... 2/69
D458,435 S * 6/2002 Rogone et al. ..... D2/823
6,438,758 B1 * 8/2002 Burkard et al. ..... 2/115
6,477,710 B1 * 11/2002 Ojoyeyi ..... 2/69
6,499,143 B2 * 12/2002 Garza ..... 2/114

* cited by examiner

PREMATURE INFANT GOWN

DESCRIPTION

1. Technical Field

This invention relates to a garment for premature infants and the like, and in particular to a gown which can be selectively and completely opened to expose the wearer for treatment and x-ray photography, and which can also be fully closed yet still accommodate tubes and sensors extending from various portions of the gown.

2. Background of the Invention

Premature infants require specialized and constant care. Typically, using modern medical methods, premature infants are connected to various tubes and monitors. In this way, the infant can be properly hydrated and fed, and all body functions can be constantly monitored as the infant develops to the point of no longer needing the tubes and sensors.

Currently, premature infants are kept in an incubator, but are not clothed. Clothing has been avoided in the past because there are so many tubes and sensors extending to and from the infant that clothing would have been cumbersome, at best and could easily interfere with the functioning and positioning of the tubes and sensors.

Previous examples of robes and gowns are found in U.S. Pat. Nos. 459,106; 4,382,303; 4,688,270; 4,783,855; 5,367,7095 and 5,621,917. None are sufficiently versatile for use with intensive care patients, and particularly premature infants.

The present invention is provided to solve these and other problems, and to provide advantages and aspects not provided by prior gowns.

SUMMARY OF THE INVENTION

The invention is directed to a gown that functions easily with premature infants, irrespective of how many, and where, tubes, monitors and sensors may be located or extended. The gown comprises a front section and a rear section with the sections comprising together a garment for generally enveloping at least a torso and upper arms of the infant when worn. The rear section comprises a rear body panel with opposite, integral arm portions. The front section comprises a pair of complementary front panel portions, each front panel portion having an integral arm portion. A perimeter area of permanent connection of each front body panel portion with a corresponding area of the rear body panel is provided with the areas being proximate opposite armpits when the gown is worn. The gown also includes perimeter areas of temporary connection of the front body panels with corresponding areas of the rear body panel, with the perimeter areas of temporary connection comprising the entire tops of the arms, under arms extending from each of the perimeter areas of permanent connection, and sides extending from each of the perimeter areas of permanent connection. With the perimeter areas of temporary connection, the front body panel portions are selectively and completely severable from the rear section except at the perimeter area of permanent connection. Means is also provided for temporarily connecting the front panel positions to one another.

In accordance with one embodiment of the invention, the means for temporarily connecting the front body panel portions to one another comprises at least one pair of the straps. Also, a tie back strap is connected to and extends from each of the perimeter areas of permanent connection, so that the tie straps can be tied to the tie back straps to fully open the front portion of the gown.

The perimeter areas of temporary connection include space temporary closures. In accordance with the illustrated embodiment of the invention, the fasteners comprise snaps.

These and other advantages will be made apparent from the following description of the drawings and detailed description of the invention.

BRIEF DESCRIPTION OF THE DRAWINGS

The invention is described in greater detail in the following description of examples embodying the best mode of the invention, taken in conjunction with the drawing figures, in which.

DETAILED DESCRIPTION

Figure 1:
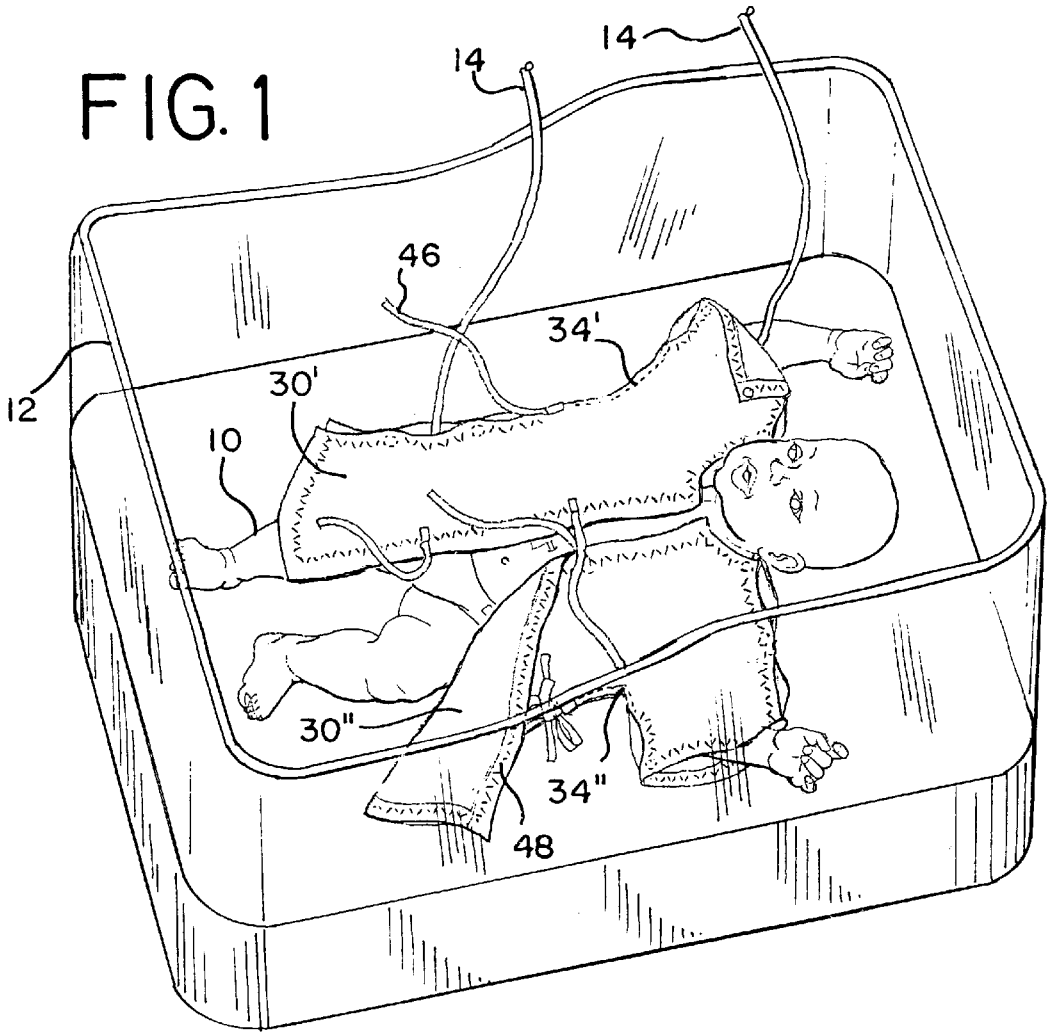
FIG. 1 is a prospective view of an infant in an incubator when wearing a gown according to the invention.

While this invention is susceptible to embodiment in many different forms, there is shown in the drawings, and will herein be described in detail, a preferred embodiment of the invention with the understanding that the present disclosure is to be considered as an exemplification of the principles of the invention and is not intended to limit the broad aspect of the invention to the embodiment illustrated.

In the following description of the invention, the terms front and rear are used for purposes of illustration and explanation. As will be evident to one skilled in the art, however, the gown according to the invention can be worn in the manner illustrated, or can be reversed, with the "front" being the rear and vice versa. The terminology is therefore used for purposes of explanation rather than limitation.

As illustrated in FIG. 1, a premature infant 10 is typically housed within an incubator, shown quite schematically at 12. For monitoring the functions of the infant and providing feeding, various tubes and sensors 14 are attached to, and extend from, the infant 10, as is well known to those familiar with care and feeding of premature infants. Quite often, a great plurality of tubes and sensors 14 is utilized, extending from all areas of the infant, but for purposes of simplicity and explanation, only a few of the tubes and sensors 14 are illustrated in FIG. 1.

Figure 2:
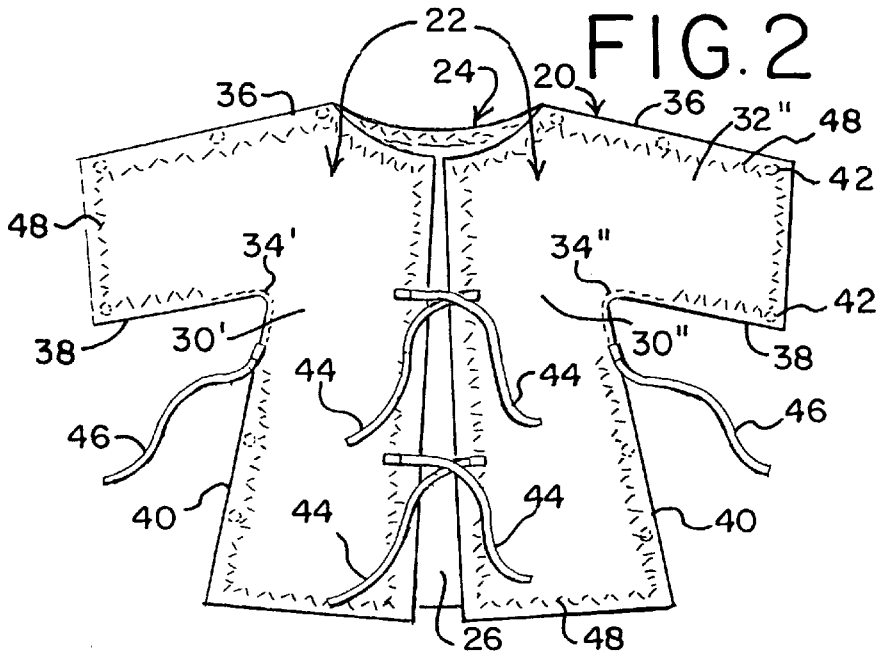
FIG. 2 is a front elevational view of the gown accordance to the invention.
Figure 3:
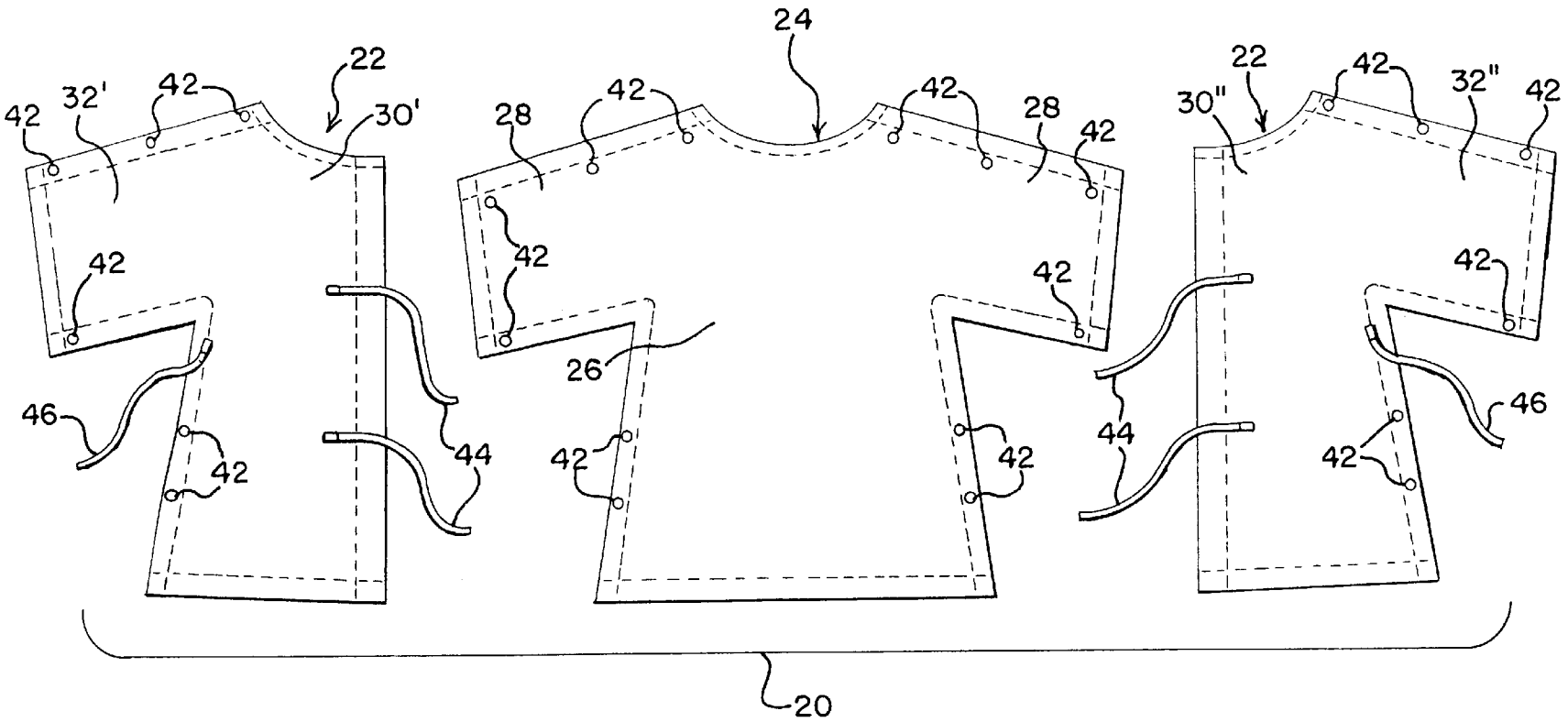
FIG. 3 is an exploded front view of the gown of the invention, showing the three primary portions of the gown before assembly.

The infant 10 is shown wearing a gown 20 according to the invention. The gown 20, as best shown in FIGS. 2 and 3, comprises a front section 22 and a rear section 24. The sections 22 and 24 together comprise a garment for generally enveloping the entire body and arms of the infant 10, as explained in greater detail below.

The rear section comprises a central rear body panel 26 with opposite, integral arm portions 28 extending from opposite sides from this panel 26. Similarly, the front section is comprised of a pair of complementary front body panel portions 30' and 30". Each of the front body panel portions 30' and 30" has a respective integral arm portion 32' and 32". As best shown in FIG. 3, the rear body panel 26 and front body panel portions 30' and 30" are sized relative to one another so that, when the front section 22 and the rear section 24 are joined to one another, the front section 22 comprises essentially half of the gown 10 and the rear section 24 comprises the other half of the gown 20.

There is only one, relatively small, area of permanent connection of each front body panel portion 30', 30" to its respective part of the rear body panel 26. That area of permanent connection comprises opposite perimeter areas of permanent connection 34' and 34" connecting respective body panel portions 30' and 30" with corresponding areas of the rear body panel 26. As shown in FIGS. 1 and 2, the perimeter areas of permanent connection are proximate the armpits of the infant 10 when the gown 20 is worn.

All other perimeter areas of the front section 22 and rear section 24 where the gown is joined are perimeter areas of temporary connection of the front body panel portions 30' and 30" to corresponding areas of the rear body panel 26. The perimeter areas of temporary connection comprise three portions of the gown 20, the entire tops of the arms 36, the underarms 38 extending from each of the perimeter connection 34' and 34", and finally the sides 40 extending from each of the perimeter areas of permanent connection 34' and 34". The temporary areas 36, 38 and 40 are connectable such that the front body panel portions 30', 30" are selectively and completely severable from the rear section 24 except at the perimeter areas of permanent connection 34' and 34". This permits the gown 20 to be selectively or fully opened to allow access to the infant 10, x-rays to be taken, or other necessary procedures to take place during the treatment of the infant.

The remaining perimeter areas of temporary connection are provided with a series of closures 42. The closures 42 can be snaps, buttons, Velcro (i.e., hook-and-loop) fasteners, or any other type of means for temporarily connecting the front body panel portions 30' and 30" and arm portions 32', 32" to the corresponding parts of the rear body panel 26 and arm portions 28. As shown in the drawings, the closures 42 are spaced from one another and can be selectively opened to allow passage of tubes and sensors 14 or any other devices that may be utilized to treat the infant 10.

For temporarily connection the front body panel portions 30' and 30" to one another, tie straps 44 are provided. The tie straps 44 can be tied to one another in a normal fashion. At least one pair of tie straps is provided, and depending on the size of the gown 20, two or more pairs of tie straps 44 can be provided for closure. Again, the pairs of tie straps 44 are spaced from one another to allow easy access to the infant 10 and application of any tubes and sensors in that vicinity.

To allow the front body panel sections to be retracted, each side of the gown 20 is provided with a tie back strap 46. As illustrated, the tie back straps 46 are preferably connected to and extend from each of the perimeter areas of permanent connections 34', 34".

Preferably the gown 20 is made of a fabric that is comfortable to the infant 10. It is contemplated by the present invention that the fabric may be a fire retardant material, or any of the materials suitable for use in applications for children. Typically the fabric needs to be hemmed, and as illustrated, all edges of the fabric 10 are folded over and hemmed by a stitching 48. Depending on the type of fabric employed, hemming and stitching 48 may or may not be required.

The invention provides a gown, particularly for premature infants, which is comfortable, allows ready access, and readily accommodates any number of tubes, sensors or other devices required for treating of an infant.

While the specific embodiment have been illustrated and described, numerous modifications come to mind without significantly departing from the spirit of the invention and the scope of protection is only limited by the scope of the accompanying Claims.

What is claimed is:

1. A gown for premature infants and the like, the gown comprising:

a front section and a rear section, said front and rear sections comprising together a garment for generally enveloping at least a torso and arms of an infant when worn, said rear section comprising a rear body panel with opposite, integral arm portions, said front section comprising a pair of complementary front body panel portions, each front body panel portion having an integral arm portion;

a perimeter area of permanent connection of each front body panel portion with a corresponding perimeter area of said rear body panel, said perimeter areas being proximate opposite arm pits when the gown is worn, perimeter areas of temporary connection of said front body panels with corresponding perimeter areas of said rear body panel, said perimeter areas of temporary connection comprising entire tops of the arms, under arms extending from each of said perimeter areas of permanent connection, and sides extending from each of said perimeter areas of permanent connection, wherein the front body panel portions are selectively and completely severable from said rear section except at said perimeter area of permanent connection; and, means for temporarily connecting said front body panel portions to one another.

2. The gown according to claim 1 wherein said means for temporarily connecting comprises at least one pair of tie traps.

3. The gown according to claim 2 wherein said means for temporarily connecting comprises two pairs of said tie straps.

4. The gown according to claim 2 further including a tie back strap connected to and extending from each of said perimeter areas of permanent connection.

5. The gown according to claim 1 wherein said perimeter areas of temporary connection include spaced, temporary closures.

6. The gown according to claim 5 wherein said closures comprise snaps.

* * * * *